US010508004B2

(12) United States Patent
Fargo

(10) Patent No.: US 10,508,004 B2
(45) Date of Patent: Dec. 17, 2019

(54) LATERAL TRANSFER STATION FOR ELEVATOR HAVING A MAGNETIC SCREW PROPULSION SYSTEM

(71) Applicant: Otis Elevator Company, Farmington, CT (US)

(72) Inventor: Richard N. Fargo, Plainville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 320 days.

(21) Appl. No.: 15/519,321

(22) PCT Filed: Oct. 6, 2015

(86) PCT No.: PCT/US2015/054207
§ 371 (c)(1),
(2) Date: Apr. 14, 2017

(87) PCT Pub. No.: WO2016/060888
PCT Pub. Date: Apr. 21, 2016

(65) Prior Publication Data

US 2017/0240385 A1 Aug. 24, 2017

Related U.S. Application Data

(60) Provisional application No. 62/064,682, filed on Oct. 16, 2014.

(51) Int. Cl.
*B66B 11/04* (2006.01)
*B66B 9/00* (2006.01)
(Continued)

(52) U.S. Cl.
CPC ..... *B66B 11/0446* (2013.01); *B66B 1/36* (2013.01); *B66B 9/003* (2013.01); *B66B 9/025* (2013.01)

(58) Field of Classification Search
CPC ..... B66B 11/0446; B66B 1/36; B66B 9/003; B66B 9/025
See application file for complete search history.

(56) References Cited

U.S. PATENT DOCUMENTS 3,814,962 A * 6/1974 Baermann ..... F16H 49/005 310/103
5,183,980 A * 2/1993 Okuma ..... B66B 11/0407 187/250
(Continued)

FOREIGN PATENT DOCUMENTS

CN 2937082 Y 8/2007
CN 101112957 A 1/2008
(Continued)

OTHER PUBLICATIONS

Chinese First Office Action and Search Report for CN 201580055628.4, dated Aug. 23, 2018, 4 pages.
(Continued)

*Primary Examiner* — Michael A Riegelman
(74) *Attorney, Agent, or Firm* — Cantor Colburn LLP

(57) ABSTRACT

An elevator system includes an elevator car for travel in a hoistway; a stator positioned along the hoistway; and a magnetic screw assembly coupled to the car, the magnetic screw assembly coacting with the stator to impart motion to the elevator car; the stator including a service section having a plurality of poles to coact with the magnetic screw assembly; the stator including a transfer station section, the transfer station section of the stator including a plurality of stator permanent magnets.

11 Claims, 7 Drawing Sheets

(51) Int. Cl.
*B66B 9/02* (2006.01)
*B66B 1/36* (2006.01)

(56) References Cited

U.S. PATENT DOCUMENTS

| | | | | |
|---|---|---|---|---|
| 5,652,414 | A * | 7/1997 | Roberts | B66B 7/044 187/292 |
| 6,101,952 | A * | 8/2000 | Thornton | B60L 13/003 104/130.02 |
| 7,926,644 | B2 * | 4/2011 | Mendenhall | B65G 35/06 198/377.02 |
| 9,457,988 | B1 * | 10/2016 | Anderson | B66B 5/16 |
| 9,884,744 | B2 * | 2/2018 | Witczak | B66B 11/04 |
| 10,196,240 | B2 * | 2/2019 | Piech | B66B 11/0226 |
| 2002/0125075 | A1 * | 9/2002 | Lin | B66B 9/025 187/267 |
| 2007/0044676 | A1 * | 3/2007 | Clark | B60L 13/003 104/130.02 |
| 2009/0251258 | A1 * | 10/2009 | Rhinefrank | F03B 13/20 335/306 |
| 2013/0206514 | A1 * | 8/2013 | Kim | B66B 9/025 187/240 |
| 2014/0182977 | A1 * | 7/2014 | Chen | B66B 11/0446 187/271 |
| 2015/0307325 | A1 * | 10/2015 | Fargo | B66B 11/0438 187/250 |
| 2015/0368071 | A1 * | 12/2015 | Witczak | B66B 9/02 187/250 |
| 2017/0015526 | A1 * | 1/2017 | Fargo | B66B 11/0407 |
| 2017/0240385 | A1 * | 8/2017 | Fargo | B66B 1/36 |
| 2017/0327347 | A1 * | 11/2017 | Fargo | B23K 1/19 |
| 2017/0331360 | A1 * | 11/2017 | Fargo | B23K 9/048 |
| 2018/0009632 | A1 * | 1/2018 | Roberts | B66B 11/0407 |
| 2018/0330858 | A1 * | 11/2018 | Tangudu | H01F 7/021 |

FOREIGN PATENT DOCUMENTS

| | | | |
|---|---|---|---|
| DE | 102010046060 | A1 | 3/2012 |
| GB | 1434809 | A | 5/1976 |
| JP | 2003104658 | A | 4/2003 |
| KR | 20140020649 | A | 2/2014 |
| WO | 2010031998 | A1 | 3/2010 |
| WO | 2011140887 | A1 | 11/2011 |
| WO | 2014081407 | A1 | 5/2014 |

OTHER PUBLICATIONS

Breshears, Scott A., et al., "Magnetically Coupled Transport", WSRC-MS-98-00567, available at: http://sti.srs.gov/fulltext/ms9800567/ms9800567.html, accessed Apr. 14, 2017, 9pgs.

International Seach Report and Written Opinion for application PCT/US2015/054207, dated Dec. 15, 2015, 10pgs.

Wieler, James G., et al., "Technology: Linear Synchronous Motor Elevators Become a Reality" Elevator World Inc., available at: https://www.elevatorworld.com/magazine/synchronous/, May 1, 2012, 5 pgs.

* cited by examiner

LATERAL TRANSFER STATION FOR ELEVATOR HAVING A MAGNETIC SCREW PROPULSION SYSTEM

FIELD OF INVENTION

The subject matter disclosed herein relates generally to the field of propulsion systems, and more particularly, to a lateral transfer station for an elevator having a magnetic screw propulsion system.

BACKGROUND

Self-propelled elevator systems, also referred to as ropeless elevator systems, are useful in certain applications (e.g., high rise buildings) where the mass of the ropes for a roped system is prohibitive and there is a need for multiple elevator cars in a single hoistway. An exemplary self-propelled elevator system is disclosed in published International application WO2014081407. There exist self-propelled elevator systems in which a first hoistway is designated for upward traveling elevator cars and a second hoistway is designated for downward traveling elevator cars. A transfer station at each end of the hoistway is used to move cars laterally between the first hoistway and second hoistway.

BRIEF SUMMARY

According to an exemplary embodiment, an elevator system includes an elevator car for travel in a hoistway; a stator positioned along the hoistway; and a magnetic screw assembly coupled to the car, the magnetic screw assembly coacting with the stator to impart motion to the elevator car; the stator including a service section having a plurality of poles to coact with the magnetic screw assembly; the stator including a transfer station section, the transfer station section of the stator including a plurality of stator permanent magnets.

In addition to one or more of the features described above, or as an alternative, further embodiments could include the magnetic screw including a first permanent magnet arranged along a helical path, a pitch of the helical path matching a pitch of first stator permanent magnets.

In addition to one or more of the features described above, or as an alternative, further embodiments could include the magnetic screw including a second permanent magnet arranged along a second helical path, a pitch of the second helical path matching a pitch of second stator permanent magnets, the second permanent magnet having an opposite polarity to the first permanent magnet.

In addition to one or more of the features described above, or as an alternative, further embodiments could include the service section of the stator has a first arc and the transfer station section of the stator surrounds has a second arc, the first arc greater than the second arc.

In addition to one or more of the features described above, or as an alternative, further embodiments could include the first arc is greater than about 180° and the second arc is less than or equal to about 180°.

In addition to one or more of the features described above, or as an alternative, further embodiments could include the first arc is greater than about 270°.

In addition to one or more of the features described above, or as an alternative, further embodiments could include a backup propulsion assembly coupled to the car, the backup propulsion assembly including a mechanical screw, wherein in the transfer station section of the stator, the poles proximate the mechanical screw are removed.

In addition to one or more of the features described above, or as an alternative, further embodiments could include the mechanical screw of the backup propulsion assembly traveling within the service section of the stator when the backup propulsion assembly is inactive.

In addition to one or more of the features described above, or as an alternative, further embodiments could include the mechanical screw of the backup propulsion assembly engaging the service section of the stator when the backup propulsion assembly is active.

In addition to one or more of the features described above, or as an alternative, further embodiments could include a brake positioned at an end of the magnetic screw assembly to apply a braking force to the magnetic screw assembly.

In addition to one or more of the features described above, or as an alternative, further embodiments could include at least one support in the hoistway, the support extendable beneath the car upon the car traveling in the transfer station section of the stator.

According to another exemplary embodiment, a method for positioning an elevator car in a lateral transfer station, the car having a magnetic screw assembly coupled thereto coacting with a stator in the hoistway includes operating the magnetic screw assembly to position the car in a transfer station; and operating the magnetic screw assembly to align permanent magnets of the magnetic screw assembly with stator permanent magnets of the same polarity in a transfer station section of the stator.

In addition to one or more of the features described above, or as an alternative, further embodiments could include prior to operating the magnetic screw assembly to align permanent magnets of the magnetic screw assembly with stator permanent magnets: engaging a support to be positioned under the car; operating the magnetic screw assembly to place the car in contact with the support.

In addition to one or more of the features described above, or as an alternative, further embodiments could include imparting lateral motion to the elevator car to move the elevator car away from the stator.

In addition to one or more of the features described above, or as an alternative, further embodiments could include operating the magnetic screw assembly to align permanent magnets of the magnetic screw assembly with stator permanent magnets includes rotating the magnetic screw one half rotation.

Other aspects, features, and techniques of embodiments of the invention will become more apparent from the following description taken in conjunction with the drawings.

BRIEF DESCRIPTION OF THE DRAWINGS

Referring now to the drawings wherein like elements are numbered alike in the FIGURES.

DETAILED DESCRIPTION

Figure 1:
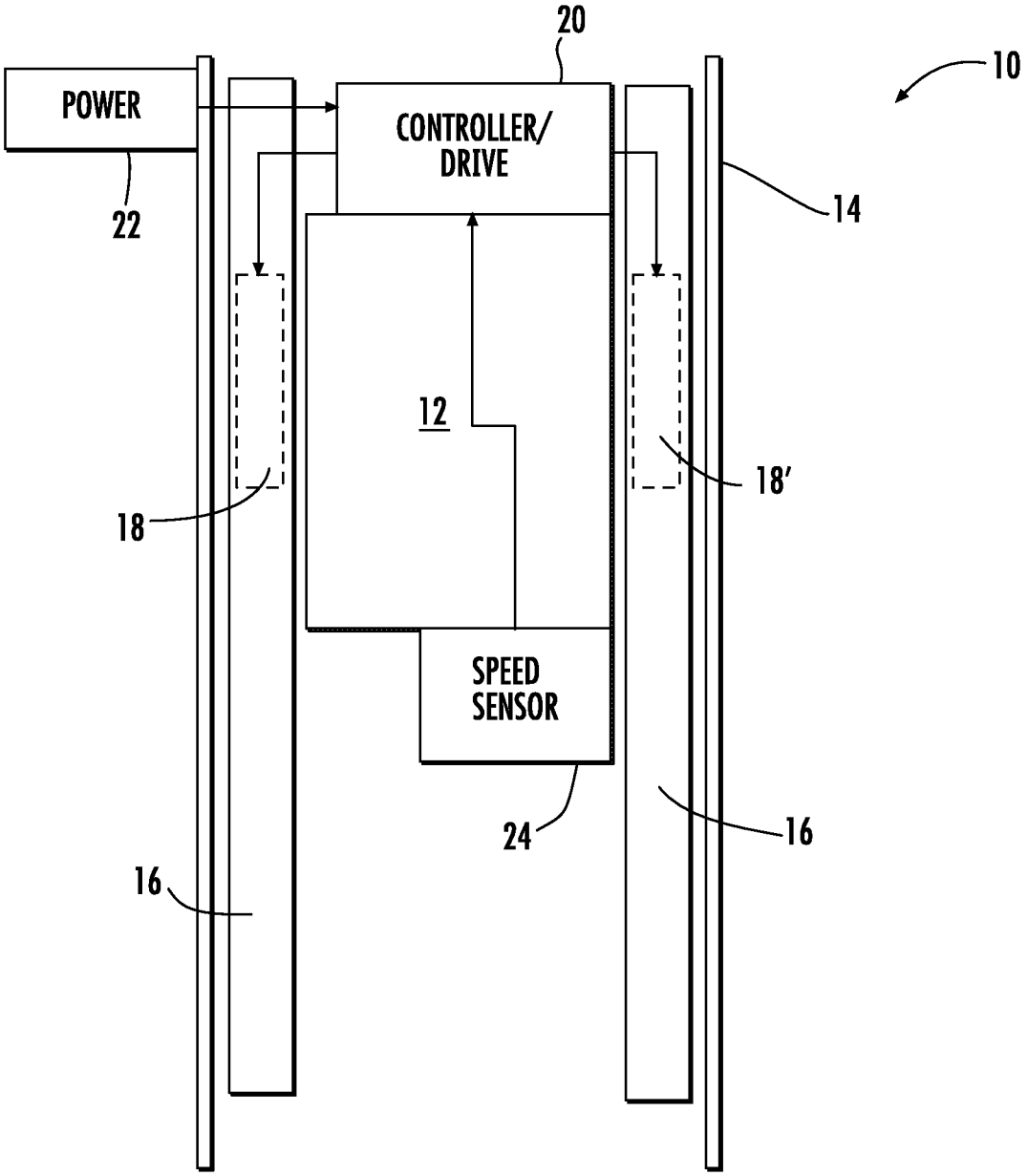
FIG. 1 depicts an elevator system having a magnetic screw propulsion system in an exemplary embodiment.

FIG. 1 depicts an elevator system 10 having a magnetic screw propulsion system in an exemplary embodiment. Elevator system 10 includes an elevator car 12 that travels in a hoistway 14. Stators 16 are positioned in the hoistway 14 and coact with magnetic screw assemblies 18 and 18' coupled to car 12 to impart motion to car 12. Stator 16 and magnetic screw assemblies 18 and 18' are described in further detail herein. It is understood that other components of the elevator system (e.g., guide rails, safeties) are not show for ease of illustration.

A controller 20 provides control signals to the magnetic screw assemblies 18 and 18' to control motion of the car (e.g., upwards or downwards) and to stop car 12. Controller 20 may be implemented using a general-purpose microprocessor executing a computer program stored on a storage medium to perform the operations described herein. Alternatively, controller 20 may be implemented in hardware (e.g., ASIC, FPGA) or in a combination of hardware/software. Controller 20 may also be part of an elevator control system. Power source 22 provides power to motors in the magnetic screw assemblies 18 and 18' under the control of controller 20. Power source 22 may be distributed along a rail in the hoistway 14 to power magnetic screw assemblies 18 and 18' as car 12 travels. A speed sensor 24 provides a speed signal indicative of the speed of car 12 to controller 20. Controller 20 can alter the control signals to the magnetic screw assemblies 18 in response to car speed. It is understood that other sensors (e.g., position sensor, accelerometers) may be used for controlling motion of car 12.

Figure 2:
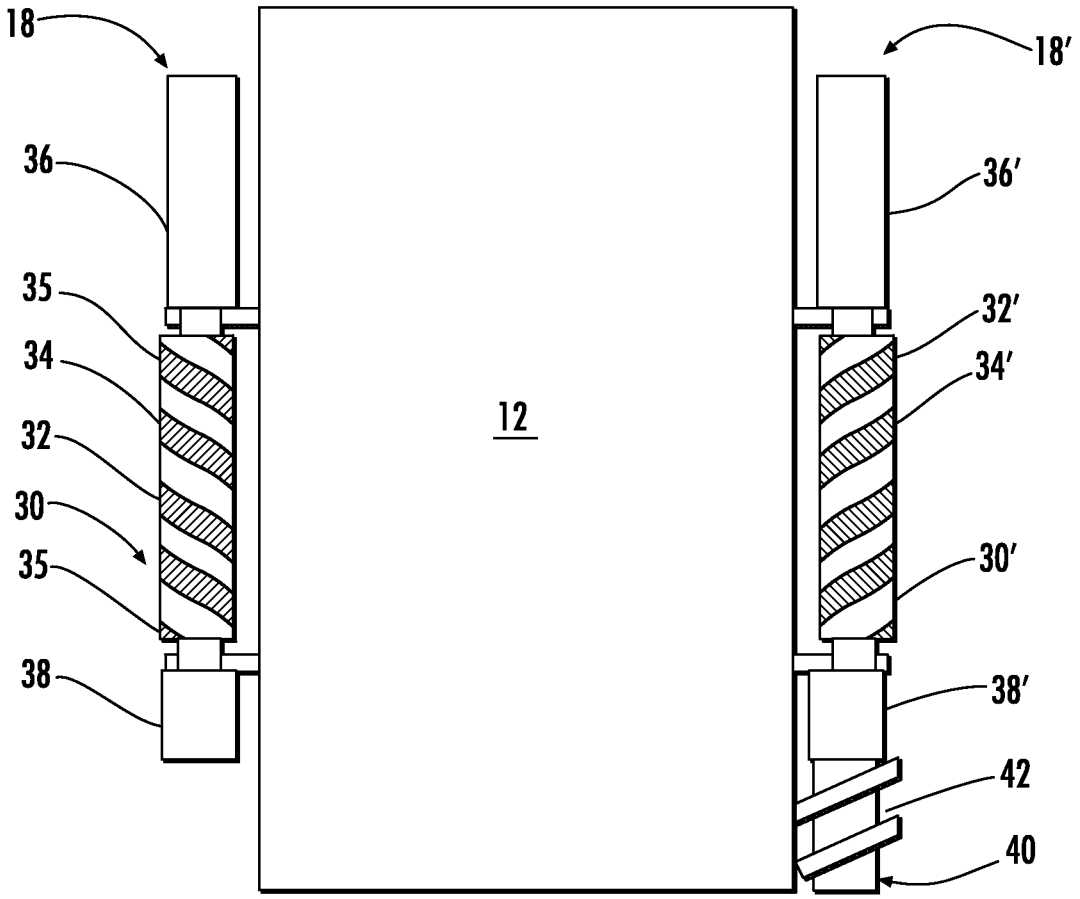
FIG. 2 depicts an elevator car and magnetic screw assemblies in an exemplary embodiment.

FIG. 2 depicts an elevator car 12 and magnetic screw assemblies 18 and 18' in an exemplary embodiment. Magnetic screw assembly 18 includes a magnetic screw 30 having a magnetic element in the form of first permanent magnet 32 of a first polarity positioned along a non-linear (e.g., helical) path along a longitudinal axis of the magnetic screw 30. A second magnetic element in the form of a second permanent magnet 34 of a second polarity (opposite the first polarity) is positioned along a non-linear (e.g., helical) path along a longitudinal axis of the magnetic screw 30. The paths of the first permanent magnet 32 and second permanent magnet 34 do not intersect.

A motor 36 (e.g., a spindle motor) is positioned at a first end of the magnetic screw 30 and rotates the magnetic screw 30 about its longitudinal axis in response to control signals from controller 20. In an exemplary embodiment, the outer diameter of motor 36 is less than the outer diameter of magnetic screw 30 to allow the motor 36 to travel within a cavity in stator 16. A brake 38 (e.g., a disk brake) is positioned at a second end of the magnetic screw 30 to apply a braking force in response to control signals from controller 20. In an exemplary embodiment, the outer diameter of brake 38 is less than the outer diameter of magnetic screw 30 to allow the brake 38 to travel within a cavity in stator 16. In an exemplary embodiment, brake 38 may be a disk brake. Further, brake 38 may be part of motor 36 in a single assembly. Magnetic screw assembly 18 is coupled to the car 12 through supports, such as rotary and/or thrust bearings.

A second magnetic screw assembly 18' may be positioned on an opposite side of car 12. Components of the second magnetic screw assembly 18' are similar to those in the first magnetic screw assembly 18 and labeled with similar reference numerals. Magnetic screw 30' has a first permanent magnet 32' of a first polarity positioned along a non-linear (e.g., helical) path along a longitudinal axis of the magnetic screw 30'. A second permanent magnet 34' of a second polarity (opposite the first polarity) is positioned along a non-linear (e.g., helical) path along a longitudinal axis of the magnetic screw 30'.

The pitch direction of the helical path of the first permanent magnet 32' and the second permanent magnet 34' is opposite that of the helical path of the first permanent magnet 32 and the second permanent magnet 34. For example, the helical path of the first permanent magnet 32 and the second permanent magnet 34 may be counter clockwise whereas the helical path of the first permanent magnet 32' and the second permanent magnet 34' is clockwise. Further, motor 36' rotates in a direction opposite to the direction of motor 36. The opposite pitch and rotation direction of the magnetic screw assemblies 18 and 18' balances rotational inertia forces on car 12 during acceleration.

A backup propulsion assembly 40 is coupled to car 12 to impart motion to car 12 in overload situations. The backup propulsion assembly 40 includes a mechanical screw 42 that normally travels within stator 16 without coacting with stator 16 when the backup propulsion assembly 40 is inactive. Upon a fault, the backup propulsion assembly 40 is active and the mechanical screw 42 is positioned to engage the stator 16. Rotation of the mechanical screw 42 imparts motion to car 12.

Figure 3:
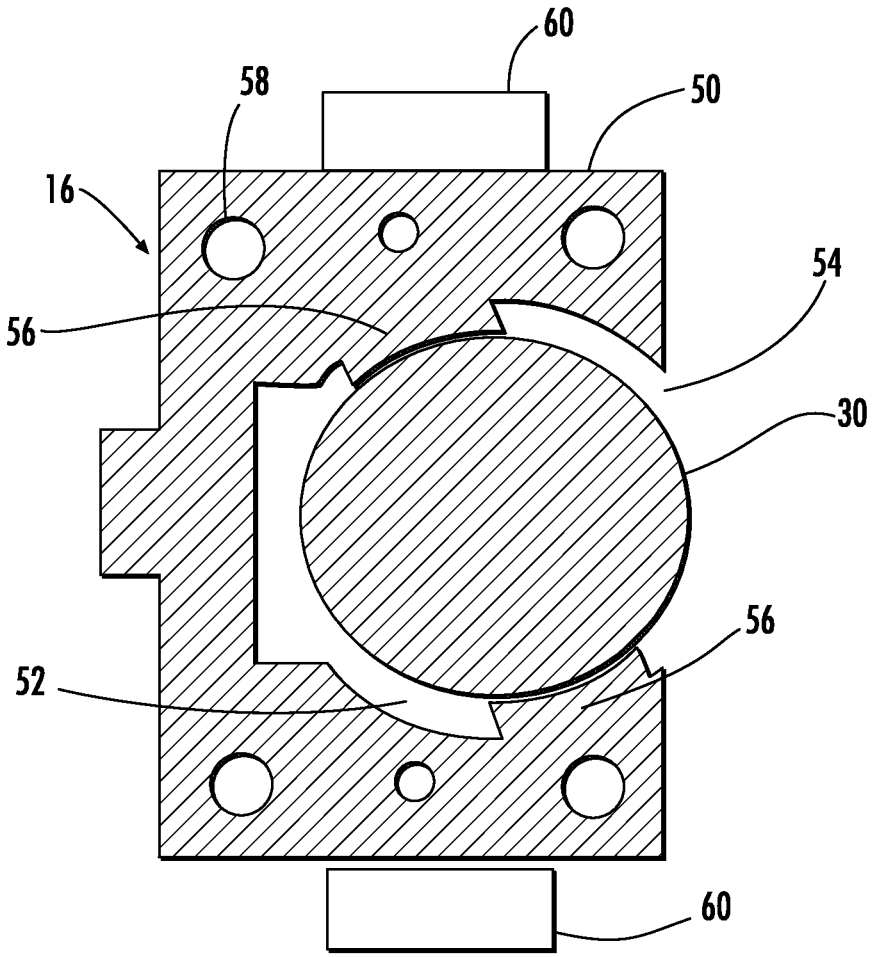
FIG. 3 is a top view of a stator and a magnetic screw in an exemplary embodiment.

FIG. 3 is a top view of stator 16 and magnetic screw 30 in an exemplary embodiment. Stator 16 has a body 50 of generally rectangular cross section having a generally a circular cavity 52 in an interior of body 50. Body 50 has an opening 54 leading to cavity 52. Poles 56 extend inwardly into cavity 52 to magnetically coact with magnetic screw 30 to impart motion to the magnetic screw 30 and car 12.

Stator 16 may be formed using a variety of techniques. In one embodiment, stator 16 is made from a series of stacked plates of a ferrous material (e.g., steel or iron). As shown in FIG. 3, each plate may have holes 58 for aligning a stack of plates and bolting the plates together in stack. In other embodiments, stator 16 may be formed from a corrugated metal pipe (e.g., steel or iron) having helical corrugations. The helical corrugations serve as the poles 56 on the interior of the pipe. An opening, similar to opening 54 in FIG. 3, would be machined in the pipe. In other embodiments, stator 16 may be formed by stamping poles 56 into a sheet of ferrous material (e.g., steel or iron) and then bending the sheet along its longitudinal axis to form stator 16.

The outer surfaces of body 50 may be smooth and provide a guide surface for one or more stiff guide rollers 60. Guide rollers 60 may be coupled to the magnetic screw assembly 18 to center the magnetic screw 30 within stator 16. Centering the magnetic screw 30 in stator 16 maintains an airgap between the magnetic screw 30 and poles 56. A lubricant or other surface treatment may be applied to the outer surface of body 50 to promote smooth travel of the guide rollers 60.

Figure 4:
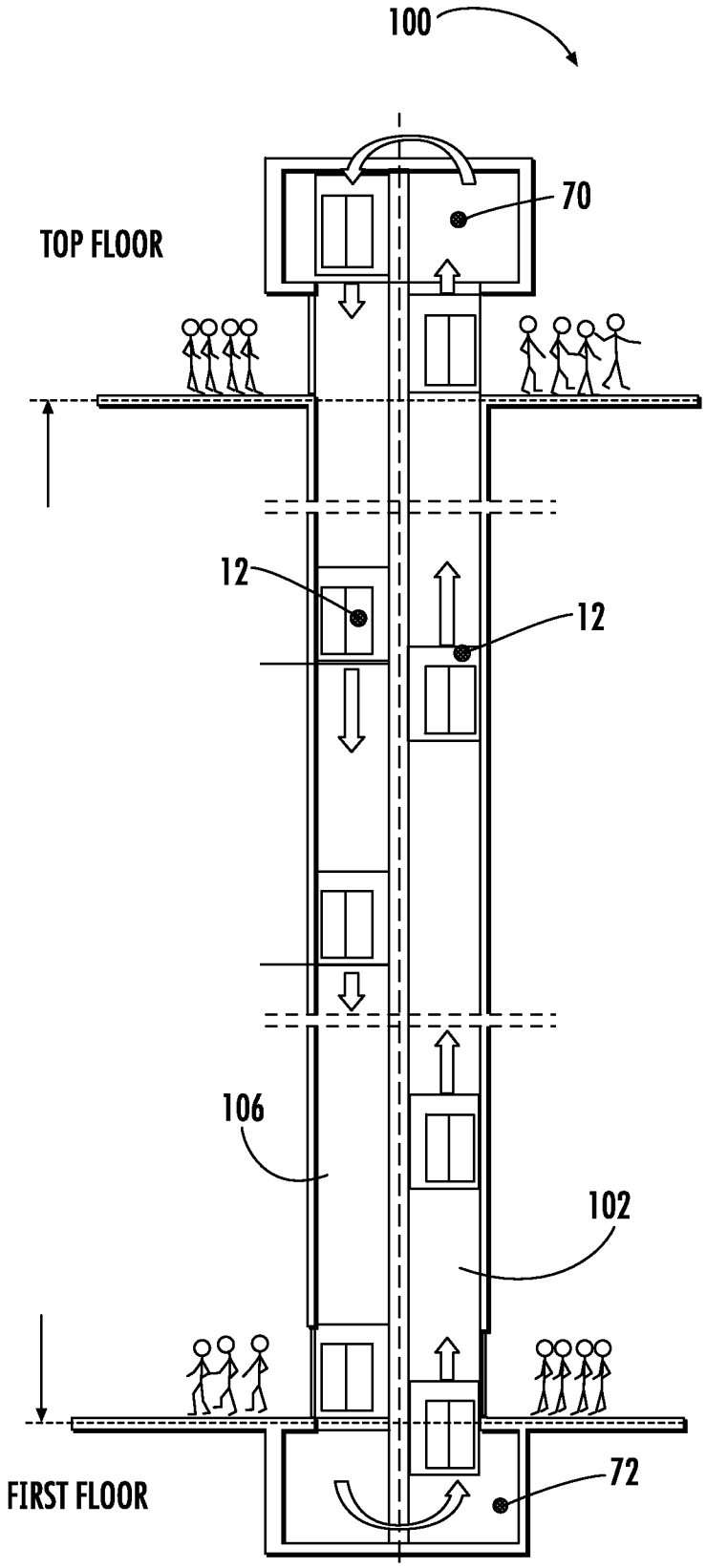
FIG. 4 depicts a circulating, ropeless elevator system in an exemplary embodiment.

FIG. 4 depicts an elevator system 100 in an exemplary embodiment. Elevator system 100 includes a first hoistway 102 in which elevators cars 12 travel upward. Elevator system 100 includes a second hoistway 106 in which elevators cars 14 travel downward. Elevator system 100 transports elevators cars 12 from a first floor to a top floor in first hoistway 102 and transports elevators cars 12 from the top floor to the first floor in second hoistway 106. The portion of the hoistways for conveying passengers is referred to as a service section. Above the top floor is an upper transfer station 70 to impart lateral motion (e.g., front-back or left-right) to elevator cars 12 to move elevator cars 12 from the first hoistway 102 to the second hoistway 106. It is understood that upper transfer station 70 may be located at the top floor, rather than above the top floor. Below the first floor is a lower transfer station 70 to impart lateral motion to elevator cars 12 to move elevator cars 12 from the second hoistway 106 to the first hoistway 102. It is understood that lower transfer station 72 may be located at the first floor, rather than below the first floor. Although not shown in FIG. 1, elevator cars 12 may stop at intermediate floors to allow ingress to and egress from an elevator car intermediate the first floor and top floor. Also, intermediate transfer stations may be employed between the first floor and top floor, depending on the design of the building.

Figure 5A:
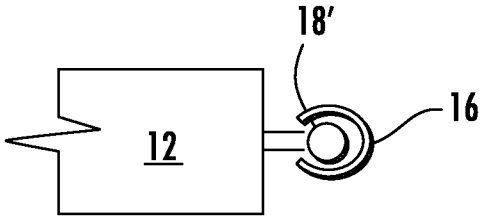
FIGS. 5A and 5B depict a magnetic screw assembly and service section of a stator in an exemplary embodiment.
Figure 5B:
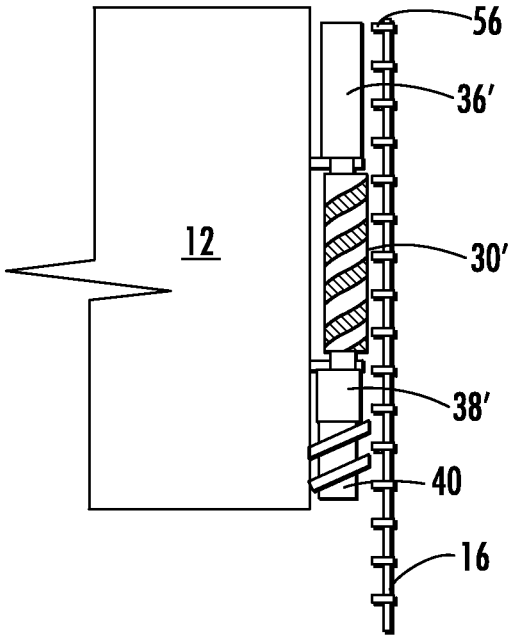

FIG. 5A depicts a top down view of stator 16 and magnetic screw assembly 18' in the service section of the stator. FIG. 5B depicts a cross section of stator 16. As noted above, the service section of the stator 16 is used in sections of the hoistway for conveying passengers. The stator 16 in the service section of hoistway 14 is similar to that shown in FIG. 3. That is, the stator 16 occupies an arc of more than about 180° and includes a plurality of stator poles 56 (FIG. 5B). In other embodiments, the stator 16 occupies an arc of more than about 270° (e.g., about 330°). Stator 16 used with magnetic screw assembly 18 on the opposite side of car 12 may be arranged similarly.

Figure 6A:
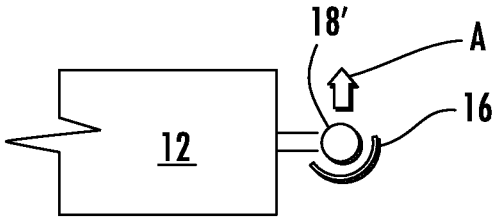
FIGS. 6A and 6B depict a magnetic screw assembly and transfer station section of a stator in an exemplary embodiment.

FIG. 6A depicts a top down view of stator 16 and magnetic screw assembly 18' in a transfer station section of the stator. The transfer station section of stator 16 is used in transfer stations 70 and/or 72. The transfer station section of stator 16 is designed to facilitate lateral movement of car 12, so that car 12 can more easily be moved away from stator 16. In the exemplary embodiment of FIG. 6A, the desired direction for lateral movement of car 12 is shown by arrow A. Stator 16 used with magnetic screw assembly 18 on the opposite side of car 12 may be arranged similarly.

One feature that allows the car 12 and magnetic screw assembly 18' to move from stator 16 is the arc of the stator 16. In an exemplary embodiment, the stator 16 occupies an arc less than or equal to about 180° (e.g., about)165°), as shown in FIG. 6A. The stator 16 provides an opening through which the magnetic screw assembly 18' can laterally move in the direction A.

Figure 6B:
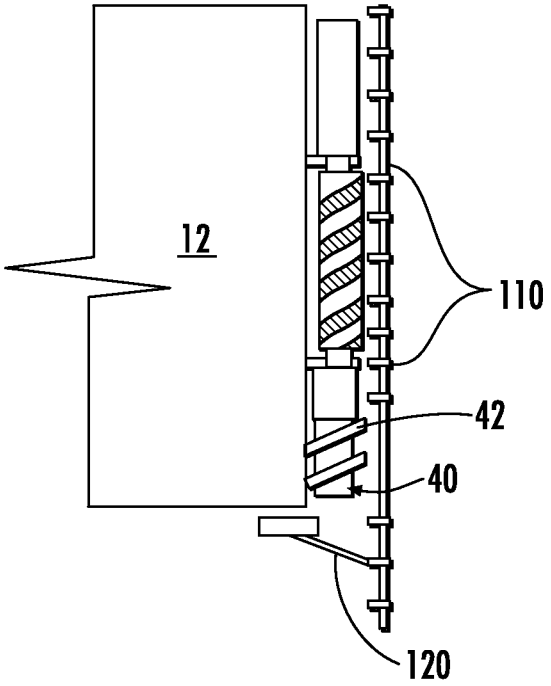

FIG. 6B depicts a cross section of stator 16 in a transfer station section of the stator. In the transfer station section of the stator 16, poles 56 located proximate the backup propulsion assembly 40 are removed, so that mechanical screw 42 does not engage poles 56 to prevent motion of car 12 in direction A. Further, poles 56 proximate to magnetic screw 30' are replaced with stator permanent magnets 110 that serve to provide magnetic repulsion against the magnetic screw 30' in the direction A. Stator permanent magnets 110 are arranged in alternating north and south polarity, at the same pitch as the first permanent magnet 32' and the second permanent magnet 34' on the magnetic screw 30'.

A support 120 is used to support car 12 in the transfer station. Support 120 may be spring biased to deflect under car 12, once car 12 passes support 120. Support 120 may be controlled by an actuator and driven into place once car 12 passes a certain point in the transfer station.

Figure 7:
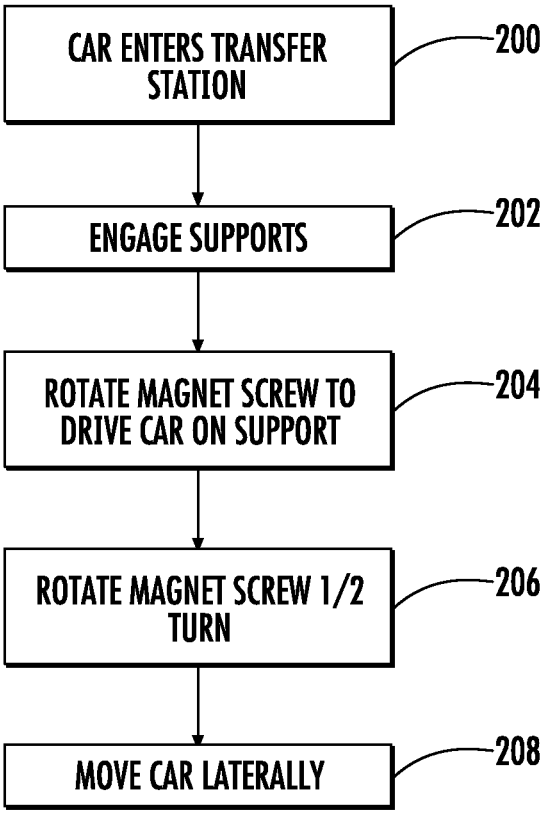
FIG. 7 is flowchart of a process for positioning a car in a transfer station in an exemplary embodiment.

An exemplary method for lateral transfer of car 12 in transfer station 70/72 is described with reference to FIG. 7. The process begins at 200, where car 12 enters the transfer station and proceeds far enough into the transfer station to begin the transfer process. A position sensor (not shown) may be used to determine if car 12 is in the proper position to initiate the transfer process. Once car 12 is in the proper position, supports 120 are positioned beneath car 12 as shown at 202. At 204, one or both of magnetic screw(s) 30, 30' are operated to drive car 12 onto support 120. This may entail reversing direction of travel of car 12 if the transfer station is at the top of the hoistway.

At 206, one or both of magnetic screw(s) 30, 30' are turned another half turn, to align permanent magnets 32 and 34 on magnetic screw with similar polarity stator magnets 110 on stator 16. This creates a repulsive force between one or both of magnetic screw(s) 30, 30' and the stator permanent magnets 110 in the direction, A. Car 12 can then be moved horizontally or laterally by transfer station components at 208. Due to the repulsive force between one or both of magnetic screw(s) 30, 30' and the stator permanent magnets 110, it is easier for the transfer station to separate car 12 from stator 16.

To reinstall car 12 to the hoistway 14, the reverse process may be followed. That is, one or both of magnetic screw(s) 30, 30' are turned a half turn, to align permanent magnets 32 and 34 on magnetic screw with opposite polarity stator magnets 110 on stator 16. Car 12 can then be loaded onto supports 120 in hoistway 14, while the attraction between one or both of magnetic screw(s) 30, 30' and the opposite polarity stator magnets 110 aids in moving car 12 towards the stator. Magnetic screw assemblies 18, 18' are used to raise car 12 off support(s) 120 and the supports are retracted.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as being limited by the foregoing description, but is only limited by the scope of the appended claims.

The invention claimed is:

1. An elevator system comprising:

an elevator car for travel in a hoistway;

a stator positioned along the hoistway; and a magnetic screw assembly coupled to the car, the magnetic screw assembly coacting with the stator to impart motion to the elevator car;

the stator including a service section having a plurality of poles to coact with the magnetic screw assembly;

the stator including a transfer station section, the transfer station section of the stator including a plurality of stator permanent magnets.

2. The elevator system of claim 1 wherein:

the magnetic screw assembly includes a first permanent magnet arranged along a helical path, a pitch of the helical path matching a pitch of first stator permanent magnets.

3. The elevator system of claim 2 wherein:

the magnetic screw includes a second permanent magnet arranged along a second helical path, a pitch of the second helical path matching a pitch of second stator permanent magnets, the second permanent magnet having an opposite polarity to the first permanent magnet.

4. The elevator system of claim 1 wherein:

the service section of the stator has a first arc and the transfer station section of the stator has a second arc, the first arc greater than the second arc.

5. The elevator system of claim 4 wherein:

the first arc is greater than 180° and the second arc is less than or equal to 180 °.

6. The elevator system of claim 4 wherein:

the first arc is greater than about 270 °.

7. The elevator system of claim 1 further comprising:

a backup propulsion assembly coupled to the car, the backup propulsion assembly including a mechanical screw;

wherein in the transfer station section of the stator, the poles proximate the mechanical screw are removed.

8. The elevator system of claim 7 wherein:

the mechanical screw of the backup propulsion assembly travels within the service section of the stator when the backup propulsion assembly is inactive.

9. The elevator system of claim 8 wherein:

the mechanical screw of the backup propulsion assembly engages the service section of the stator when the backup propulsion assembly is active.

10. The elevator system of claim 1 further comprising:

a brake positioned at an end of the magnetic screw assembly to apply a braking force to the magnetic screw assembly.

11. The elevator system of claim 1 further comprising:

at least one support in the hoistway, the support extendable beneath the car upon the car traveling in the transfer station section of the stator.

* * * * *